US009834968B2

(12) United States Patent
Whitaker

(10) Patent No.: US 9,834,968 B2
(45) Date of Patent: Dec. 5, 2017

(54) SHOWER DOOR HINGE LIMITER

(71) Applicant: Thomas M. Whitaker, Stratford, CT (US)

(72) Inventor: Thomas M. Whitaker, Stratford, CT (US)

(73) Assignee: Mr. Shower Door, Inc., Stratford, CT (US)

( * ) Notice: Subject to any disclaimer, the term of this patent is extended or adjusted under 35 U.S.C. 154(b) by 0 days.

(21) Appl. No.: 15/097,885

(22) Filed: Apr. 13, 2016

(65) Prior Publication Data

US 2016/0333618 A1 Nov. 17, 2016

Related U.S. Application Data

(60) Provisional application No. 62/161,432, filed on May 14, 2015.

(51) Int. Cl.
*E05D 11/06* (2006.01)
*E05D 5/02* (2006.01)
*E05D 15/54* (2006.01)

(52) U.S. Cl.
CPC ..... *E05D 11/06* (2013.01); *E05D 5/0246* (2013.01); *E05D 15/54* (2013.01); *E05Y 2900/114* (2013.01); *Y10T 16/534* (2015.01)

(58) Field of Classification Search
CPC ..... E05D 11/06; E05D 5/0246; E05D 15/54; E05D 7/08; E05Y 2900/114; E05Y 2900/132; Y10T 16/533; Y10T 16/5335; Y10T 16/534; Y10T 16/551; Y10T 16/558; Y10T 16/554
USPC ..... 16/250, 251, 252, 374, 387, 382; 49/388
See application file for complete search history.

(56) References Cited

U.S. PATENT DOCUMENTS

| | | | | |
|---|---|---|---|---|
| 5,867,869 | A | 2/1999 | Garrett et al. | |
| 6,070,294 | A * | 6/2000 | Perkins | A47K 3/36 16/250 |
| 6,481,055 | B2 * | 11/2002 | Cheng | E05D 5/0246 16/250 |
| 6,560,821 | B2 | 5/2003 | Miller et al. | |
| 6,704,966 | B1 * | 3/2004 | Kao | E05D 5/0246 16/252 |
| 8,720,005 | B2 * | 5/2014 | Cheng | E05D 5/0246 16/252 |

* cited by examiner

*Primary Examiner* — William Miller
(74) *Attorney, Agent, or Firm* — St. Onge Steward Johnston & Reens, LLC

(57) ABSTRACT

A hinge for a door, such a glass shower door, including a back plate attachable to a surface, a hinge block extending from the back plate, a clamp rotatably coupled to the hinge block for receiving the glass shower door, and a hinge limiter attached to one of a front or a back exterior surface of the hinge block. The hinge limiter may have a length equal to or less than a length of the hinge block and a width less than a width of the hinge block. The clamp may include a stop plate on an interior surface, adjacent to a distal end of the hinge block, adapted to contact the hinge limiter upon rotation of the clamp.

20 Claims, 6 Drawing Sheets

SHOWER DOOR HINGE LIMITER

FIELD OF THE INVENTION

The invention relates to door hinges, and more specifically to a shower door hinge with a range limiting mechanism.

BACKGROUND OF THE INVENTION

Shower doors, and particularly glass shower doors, are generally provided as either a sliding door or a hinged door. When a glass door is hinged, it often includes two or more hinge mechanisms that clamp against the glass and provide for a full range of motion in either direction. Examples of such hinges are disclosed in U.S. Pat. Nos. 5,867,869 and 6,560,821, the contents of which are incorporated herein by reference. When it is desired to limit movement to only one direction, the opposite side of the glass door may be beveled to create a stop against an adjacent portion of the shower door enclosure. A stop may also be placed on the wall opposite the hinge as illustrated in FIG. 12 of U.S. Pat. No. 5,867,869.

However, it may be desired to selectively limit the range of motion of a glass shower door, such as to prevent impact of the glass against objects within or outside the shower. For example, it may be desired to selectively limit the range of the shower door at a chosen angle as not to impact a shower head or a towel bar. Prior art hinge mechanisms do not provide a mechanism to do so.

SUMMARY OF THE INVENTION

Accordingly, it is an object of the present invention to provide an improved door hinge with one or more hinge limiting mechanisms for selective adjustment of the range of rotation of the door.

These and other objects of the invention are achieved by providing a hinge for a door, such as a glass shower door, having a back plate, a hinge block attached to and/or extending from the back plate, and a clamp rotatably coupled to the hinge block. The hinge block includes one or more hinge limiters attached to a front or back exterior surface thereof. In some embodiments, the clamp includes a stop plate on an interior surface adjacent to a distal end of the hinge block which is adapted to contact the one or more hinge limiters upon rotation of the clamp.

In some embodiments, the hinge limiter has a length equal to or less than a length of the hinge block and a width less than a width of the hinge block. The hinge limiter may also have a distal end, in the width-wise direction, which is curved, chamfered, or filleted.

Further provided is a customizable hinge system including a hinge having a back plate, a hinge block attached to and/or extending from the back plate, and a clamp rotatably coupled to the hinge block. The system further includes two or more hinge limiters adapted to attach to front or back exterior surfaces of the hinge block. The two or more hinge limiters may include one hinge limiter having a first thickness and a second hinge limiter having a second thickness greater than the first thickness. The two or more hinge limiters may also include one hinge limiter having a first width and a second hinge limiter having a second width longer than the first width.

Also provided is a method of selectively limiting the pivotal range of a door. The method includes the steps of providing a hinge having a back plate, a hinge block attached to and/or extending from the back plate, and a clamp rotatably coupled to the hinge block. At least one of a plurality of hinge limiters are selectively attached or adhered to front or back exterior surfaces of the hinge block to achieve a desired pivotal range of the clamp and/or door.

The method may also include a step of removing the at least one of a plurality of hinge limiters from the hinge block and attaching another one of the at least one of a plurality of hinge limiters to the front or back exterior surfaces of the hinge block to achieve a different pivotal range.

In some embodiments, the hinge limiter has a thickness of 30% or less of a thickness of the hinge block.

DETAILED DESCRIPTION OF THE INVENTION

Figure 1:
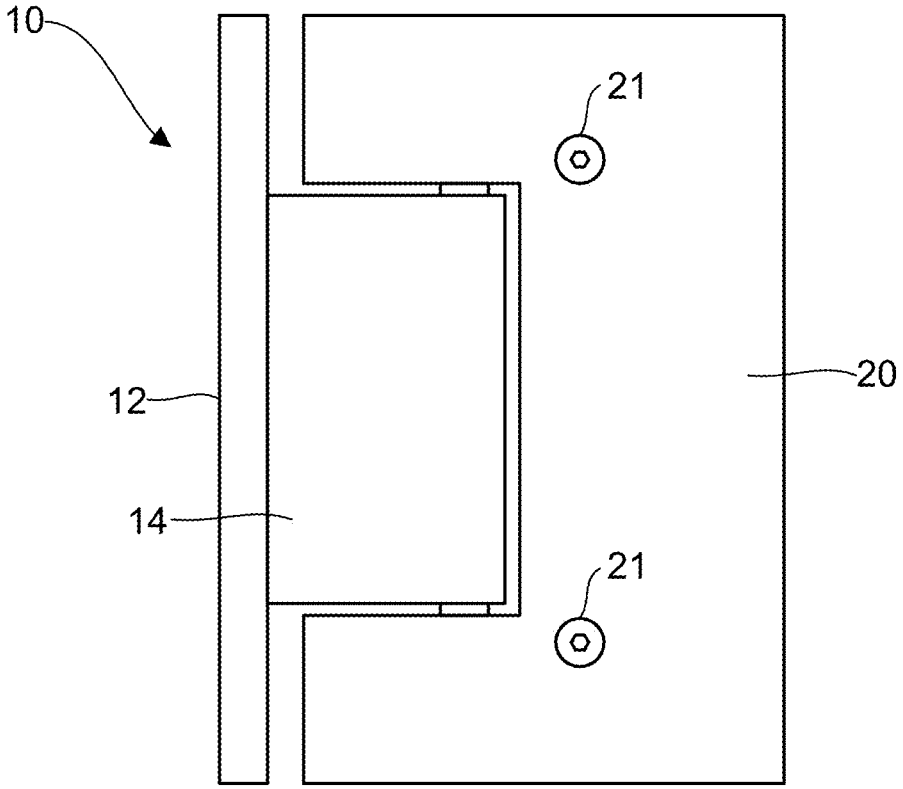
FIG. 1 is a front view of a shower door hinge adapted to receive a range limiting mechanism according to an exemplary embodiment of the present invention.
Figure 2:
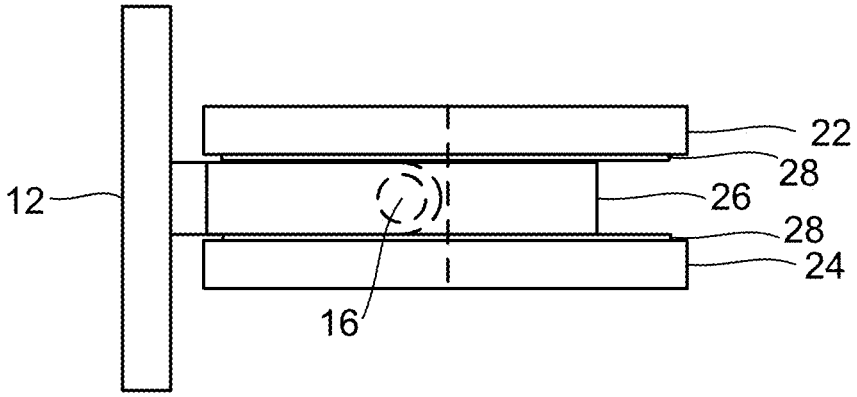
FIG. 2 is a top view of a shower door hinge adapted to receive a range limiting mechanism according to an exemplary embodiment of the present invention.
Figure 3:
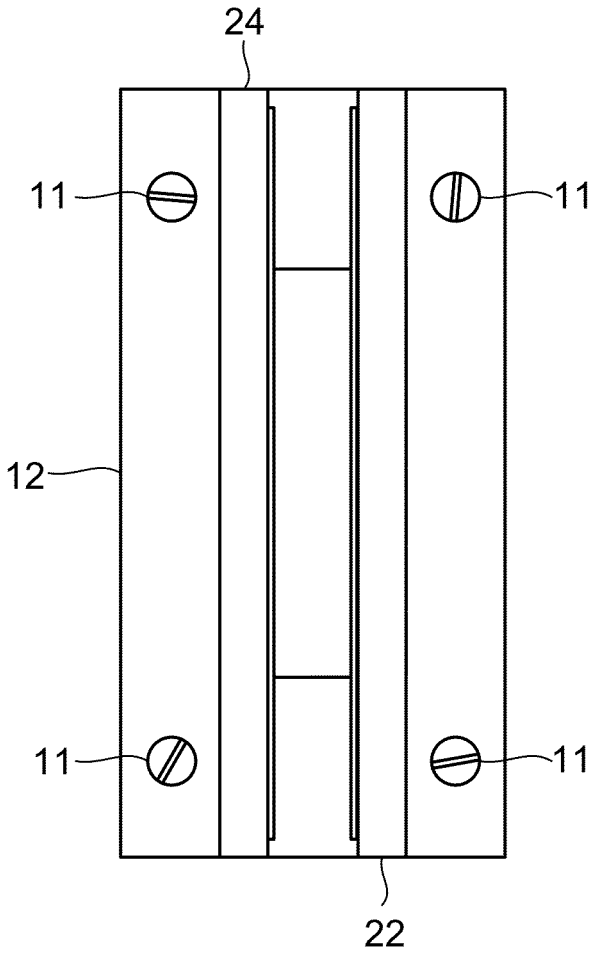
FIG. 3 is a side view of a shower door hinge adapted to receive a range limiting mechanism according to an exemplary embodiment of the present invention.

FIGS. 1-3 illustrate a door hinge 10 adapted to receive a range limiting mechanism according to the present invention. FIG. 1 is a front view of the hinge 10 and FIG. 2 is a top view of the hinge 10. FIG. 3 is a side or end view of the hinge 10. The hinge 10 includes a back plate 12, a hinge block (or tram) 14, and a clamp 20. The back plate 12 attaches the hinge 10 to a wall, such as with mechanical fasteners 11. The hinge block 14 extends (e.g., perpendicularly) from the back plate 12 and includes a center pin 16 for rotation of the hinge 10.

The clamp 20 includes a front clamp plate 24, a rear clamp plate 22, and a center block 26. The clamp 20 may also include two gaskets 28. The clamp plates 22, 24 may be attached to the center block 26 and/or a door by mechanical fasteners. In some embodiments, one or both of the clamp plates 22, 24 may be formed as a single (e.g., metal) piece with the center block 26.

The door hinge 10, and particularly the clamp 20, is adapted to attach to a door, such as glass shower door panel, to provide a hinge for the door. In particular, a glass panel may be clamped between the front and back clamp plates 22, 24 and gaskets 28. The clamp 20 may attach to the panel using mechanical fasteners 21, such as hex bolts. While the preferred embodiment relates to a glass shower door, one skilled in the art would understand that the hinge 10 may be used for other types of doors and enclosures.

Figure 4A:
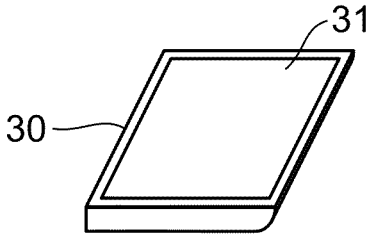
FIGS. 4A-4C illustrate range limiting mechanisms according the present invention.
Figure 4B:
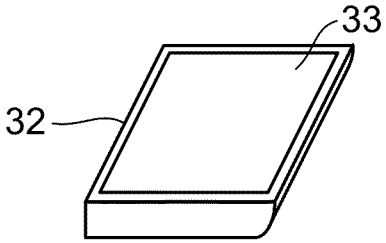
Figure 4C:
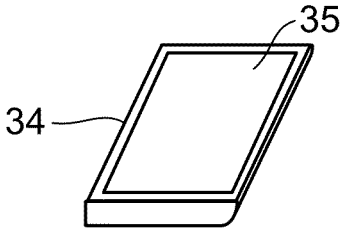

FIGS. 4A-4C illustrate various range limiting mechanisms, or hinge limiters, according the present invention. The hinge limiters 30, 32, 34 have a back surface that attaches to the hinge block 14 and a front (exterior) surface. As shown, the hinge limiters 30, 32, 34 may have any number of different thicknesses depending on the desired angle limitation. For example, the thicknesses may be between 10% and 30% of a thickness of the hinge block 14. Some hinge limiters have a thickness of less than 25% (e.g., 20%, 15%) of the thickness of the hinge block 14. In some other embodiments, the hinge limiters may have a thickness of up to 35%, up to 40%, or up to 50% of the thickness of the hinge block 14 depending on the degree of limitation desired. In one embodiment, the hinge limiters are ⅛ inch thick and 3⁄16 inch thick. In some embodiments, the widths may also vary to assist with adjusting the desired angle. The widths (in the direction of the curved distal edge) are generally greater than 50% of a total width of the hinge block 14, such as at least 60%, 75%, 85% or more. The hinge limiters 30, 32, 34 are also sized to fit against various different hinge blocks 14, having an equal or lesser top to bottom length.

A distal end of each hinge limiter 30, 32, 34 has a curved, chamfered, or filleted end. The hinge limiters also have attachment elements 31, 33, 35 on the back surface of the hinge limiter. The attachment elements 31, 33, 35 may be, for example, adhesive layers (e.g., double sided tape), epoxy, or mechanical fasters such as screws (e.g., extending through the hinge limiter in the thickness direction). As described in more detail below, the hinge limiters 30, 32, 34 of FIGS. 4A-4C may be provided together as part of a customizable system or kit with a hinge 10.

Figure 5:
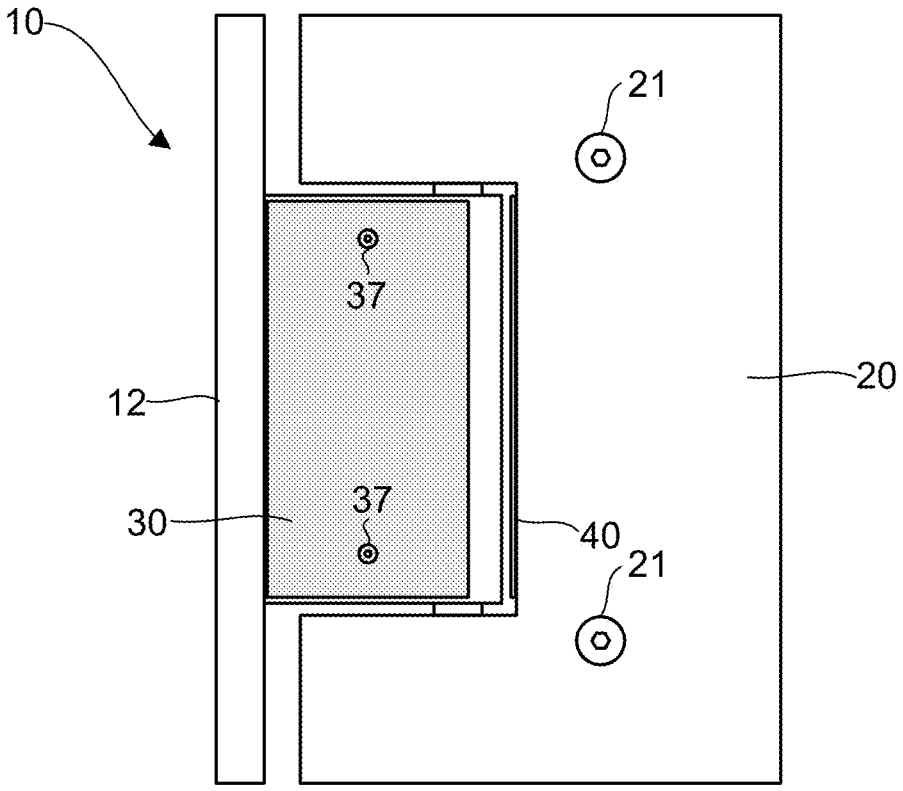
FIG. 5 is a front view of a shower door hinge including a range limiting mechanism according to an exemplary embodiment of the present invention.
Figure 6:
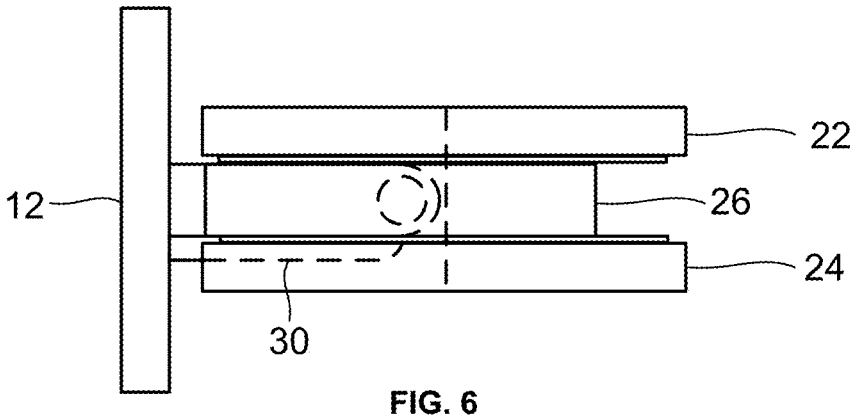
FIG. 6 is a top view of a shower door hinge including a range limiting mechanism according to an exemplary embodiment of the present invention.

FIGS. 5-6 show the hinge 10 including a hinge limiting mechanism 30, or hinge limiter. The hinge limiter 30 is adhered to a front surface of the hinge block 14, such as with an adhesive or epoxy. The hinge limiter 30 may also be attached with mechanical fasteners 37 such as screws or hex bolts. The hinge limiter 30 is preferably made of the same material as the clamp 20, e.g., polished metal, for strength and aesthetics. However, the invention may be achieved with any number of different materials, such as plastic.

The hinge limiter 30 is sized to fit against the hinge block 14, having an equal or lesser length. The hinge limiter 30 has a length (up and down direction) that is equal to or less than a length of the hinge block 14, and a width (in a direction away from the back plate 12) that is generally less than a width of the hinge block 14. In other embodiments (e.g., when it is desired to prevent any rotation in one direction), the width may be equal to the width of the hinge block 14, or even slightly greater. A distal end of the hinge limiter 30 has a curved, chamfered, or filleted end.

The clamp 20 may include a stop plate 40 adapted to impact the hinge limiter 30. Preferably the stop plate 40 impacts the front surface of the hinge limiter (i.e., compressing the limiter 30 against the block 14), though it may also at least partially impact the curved distal edge depending on the size/shape of the limiter 30 and the desired stop angle. The stop plate 40 is attached or adhered (e.g., with adhesive or epoxy) to an interior surface of the clamp 20 adjacent to a distal end of the hinge block 14. The stop plate 40 may be made of any material, but it preferably a nylon or plastic element. The stop plate 40 may protect the hinge limiter 30 and clamp 20, and also dampen noise.

Figure 7A:
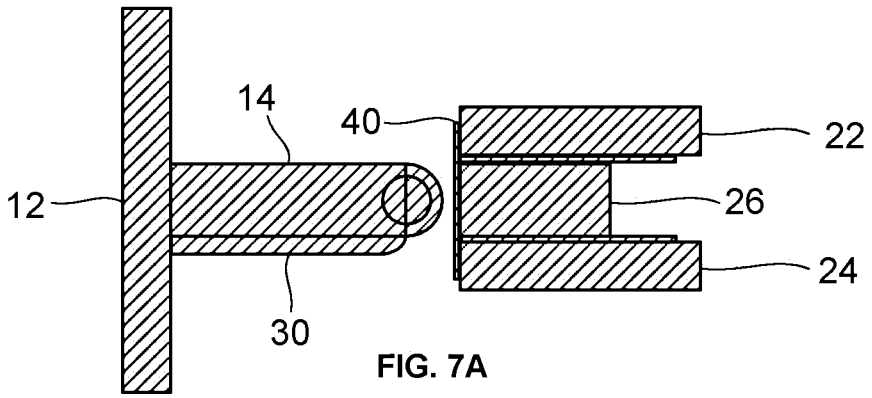
FIGS. 7A-7B are top sectional views of a shower door hinge including a range limiting mechanism according to an exemplary embodiment of the present invention.
Figure 7B:
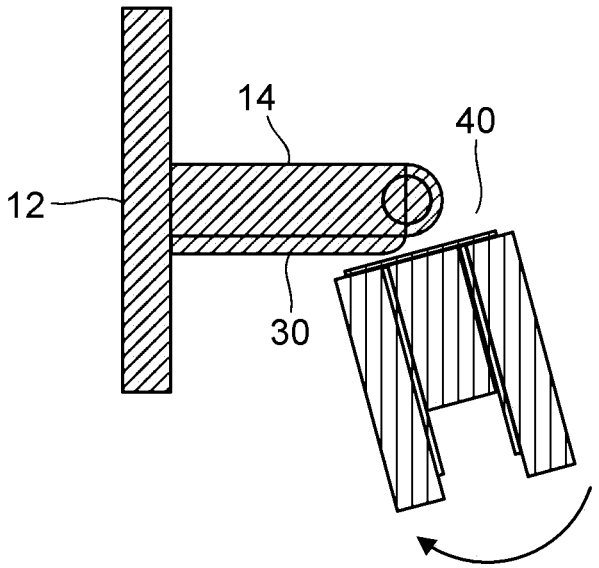

FIGS. 7A-7B illustrate how the clamp 20 rotates about the hinge block 14. In FIG. 7A, the clamp 20 is free to rotate ninety degrees (or more) in a back direction. In the front direction, the rotation is limited by the hinge limiter 30. In particular, the stop plate 40 impacts the hinge limiter 30 to arrest rotation of the clamp 20.

Figure 8A:
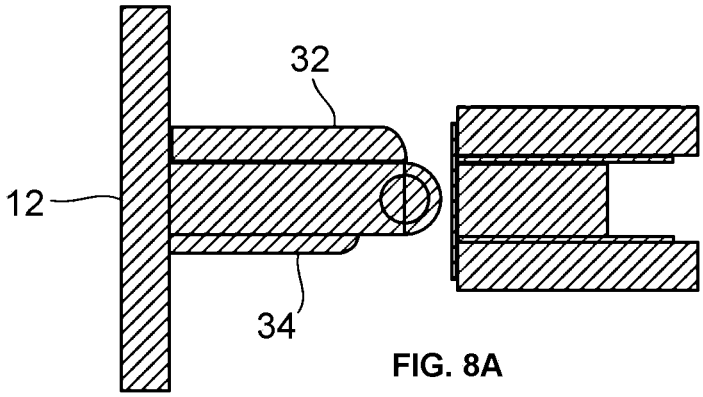
FIGS. 8A-8C are top sectional views of a shower door hinge including range limiting mechanisms according to an exemplary embodiment of the present invention.
Figure 8B:
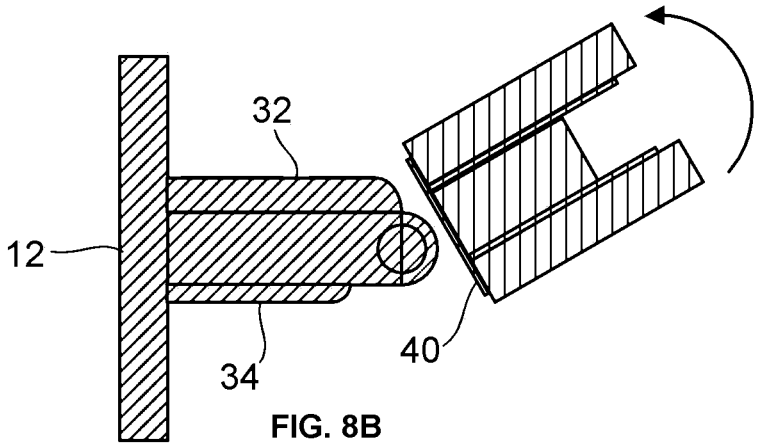
Figure 8C:
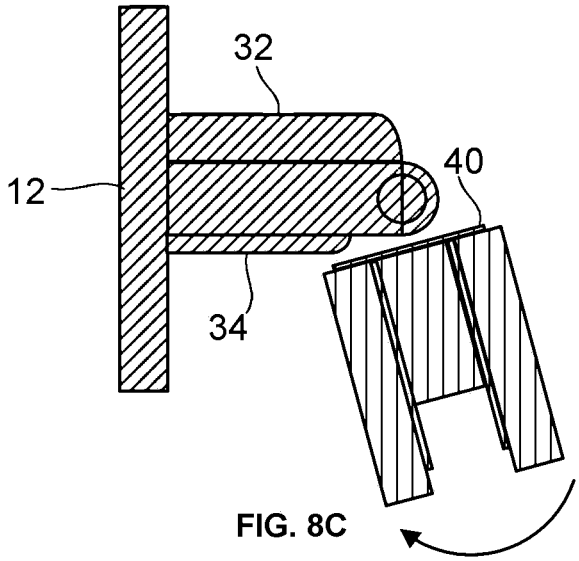

As shown in FIGS. 8A-8C, hinge limiters 30, 32, 34 may be attached to either or both sides of the hinge block 14. The thickness of the hinge limiter 30, 32, 34 may be changed to provide for different maximum angles of rotation for the shower door. In some embodiments, the width of the hinge limiter 30, 32, 24 may also be varied to likewise adjust the maximum angle of rotation. The hinge limiters 30, 32, 34 may be permanently attached to the hinge block 14 or removable in the event that it is desired to change the maximum angle of rotation.

The present invention may be embodied in a customizable system or kit to allow an installer of a shower door to easily set maximum angles of rotation in the field. The system may include the hinge 10 packaged with a plurality of hinge limiters (e.g., 30, 32, 34) adapted to attach to front or back exterior surfaces of the hinge block 14. The plurality of hinge limiters in the system may include one hinge limiter having a first thickness (e.g., ⅛ inch) and a second hinge limiter having a second thickness (e.g., 3⁄16 inch) greater than the first thickness (e.g., limiters 30, 32). The plurality of hinge limiters in the system may also include one hinge limiter having a first width and a second hinge limiter having a second width longer than the first width (e.g., limiters 30, 34). The system may also include attachment elements such as adhesive (e.g., strips sized to the back of the hinge limiters), epoxy, or mechanical fasteners to enable attachment of the hinge limiters 30, 32, 34 to the hinge block 14.

Although the invention has been described with reference to a particular arrangement of parts, features and the like, these are not intended to exhaust all possible arrangements or features, and indeed many modifications and variations will be ascertainable to those of skill in the art.

What is claimed is:

1. A hinge, comprising:

a back plate attachable to a surface;

a hinge block extending from a proximal end at said back plate to a distal end, said hinge block having a front exterior surface between the proximal end and the distal end on one side of said hinge block and a back exterior surface between the proximal end and the distal end on an opposite side of said hinge block;

a clamp rotatably coupled about the distal end of said hinge block; and a hinge limiter attached in a fixed position against one of the front or the back exterior surfaces of said hinge block, said hinge limiter limiting a maximum angle of rotation of said clamp in a first direction towards said hinge limiter whereby, during rotation of said clamp in the first direction, said clamp contacts said hinge limiter only at the maximum angle of rotation.

2. The hinge according to claim 1, wherein said hinge limiter has a length equal to or less than a length of said hinge block.

3. The hinge according to claim 2, wherein said hinge limiter has a width less than a width from the proximal end to the distal end of said hinge block.

4. The hinge according to claim 3, wherein said hinge limiter has a width-wise distal end that is curved, chamfered, or filleted.

5. The hinge according to claim 1, wherein said clamp includes a stop plate on an interior surface, adjacent to a distal end of said hinge block, adapted to contact said hinge limiter upon the rotation of said clamp.

6. The hinge according to claim 1, wherein said clamp includes a front clamp plate and a back clamp plate to receive a door panel between the front clamp plate and the back clamp plate.

7. The hinge according to claim 6, further comprising a gasket on each of the front clamp plate and the back clamp plate.

8. The hinge according to claim 1, wherein said hinge limiter has a thickness of 30% or less of a thickness between the front exterior surface and the back exterior surface of said hinge block.

9. A hinge, comprising:

a back plate attachable to a surface;

a hinge block extending from said back plate;

a clamp rotatably coupled to said hinge block;

a first hinge limiter attached to a front exterior surface of said hinge block to limit a pivotal range of said clamp; and a second hinge limiter attached to a back exterior surface of said hinge block to limit the pivotal range of said clamp.

10. The hinge according to claim 9, wherein the first hinge limiter has a width different from a width of the second hinge limiter.

11. The hinge according to claim 9, wherein the first hinge limiter has a thickness different from a thickness of the second hinge limiter.

12. A customizable hinge system, comprising:

a hinge having a back plate, a hinge block extending from the back plate, and a clamp to receive a door panel, the clamp rotatably coupled to the hinge block;

a plurality of attachment elements;

two or more hinge limiters each removably attachable against front and back exterior surfaces of the hinge block with one of said attachment elements to limit a pivotal range of said door panel.

13. The hinge system according to claim 12, wherein each of said two or more hinge limiters has a length equal to or less than a length of the hinge block and a width equal to or less than a width of said hinge block.

14. The hinge system according to claim 13, wherein each of said two or more hinge limiters has a width-wise distal end that is curved, chamfered, or filleted.

15. The hinge system according to claim 12, wherein said two or more hinge limiters include one hinge limiter having a first thickness and a second hinge limiter having a second thickness greater than the first thickness.

16. The hinge system according to claim 12, wherein said two or more hinge limiters include one hinge limiter having a first width and a second hinge limiter having a second width longer than the first width.

17. A method of selectively limiting a pivotal range of a door, the method comprising steps of:

providing a hinge having a back plate, a hinge block having a proximal end attached to the back plate and extending to a distal end with a front exterior surface between the proximal end and the distal end on one side of said hinge block and a back exterior surface between the proximal end and the distal end on an opposite side of said hinge block, and a clamp rotatably coupled about the distal end of the hinge block;

attaching, by adhesive or at least one fastener, at least one of a plurality of hinge limiters to and in a fixed position against the front or the back exterior surfaces of the hinge block to limit the pivotal range of the door.

18. The method according to claim 17, further comprising the step of removing the at least one of a plurality of hinge limiters from the hinge block and attaching another one of the at least one of a plurality of hinge limiters to the front or back exterior surfaces of the hinge block to achieve a different pivotal range.

19. The method according to claim 17, further comprising the step of attaching a second one of the plurality of hinge limiters to the front or the back exterior surface of the hinge block, wherein the second one of the plurality of hinge limiters has a thickness or a width that is different than a thickness or a width, respectively, of the at least one of a plurality of hinge limiters.

20. The method according to claim 17, wherein said at least one of a plurality of hinge limiters has a thickness of 30% or less of a thickness between the front exterior surface and the back exterior surface of the hinge block.

* * * * *